United States Patent [19]

Chillier

[11] Patent Number: 4,666,151

[45] Date of Patent: May 19, 1987

[54] MECHANICAL THERAPEUTIC APPARATUS

[76] Inventor: Maurice Chillier, 3, rue de Beaumont, 1206 - Geneva, Switzerland

[21] Appl. No.: 775,009

[22] Filed: Sep. 11, 1985

[30] Foreign Application Priority Data

Sep. 17, 1984 [CH] Switzerland ..... 4430/84

[51] Int. Cl.[4] ..... A63B 21/00

[52] U.S. Cl. ..... 272/134; 272/118; 272/136; 272/143

[58] Field of Search ..... 272/118, 134, 136, 140, 272/142, 143, 144, 145, 117

[56] References Cited

U.S. PATENT DOCUMENTS

| | | | |
|---|---|---|---|
| 3,207,512 | 9/1965 | Kinsey . | |
| 3,373,993 | 3/1968 | Oja . | |
| 3,682,475 | 8/1972 | Walker | 272/145 |
| 3,743,282 | 7/1973 | Zinkin | 272/134 X |
| 3,912,263 | 10/1975 | Yatso | 272/118 |
| 4,208,049 | 6/1980 | Wilson | 272/140 X |
| 4,346,888 | 8/1982 | Szabo . | |
| 4,358,107 | 11/1982 | Nissen | 272/136 X |
| 4,402,504 | 9/1983 | Christian | 272/142 X |
| 4,549,733 | 10/1985 | Salyer | 272/134 X |

FOREIGN PATENT DOCUMENTS

| | | | |
|---|---|---|---|
| 329380 | 7/1903 | France . | |
| 2126894 | 10/1972 | France . | |
| 8202667 | 8/1982 | PCT Int'l Appl. | 272/118 |

*Primary Examiner*—Richard J. Apley
*Assistant Examiner*—Robert W. Bahr
*Attorney, Agent, or Firm*—Young & Thompson

[57] ABSTRACT

Mechanical therapeutic apparatus comprising a vertical beam, a carriage movable with respect to the beam, guides for displacement of this carriage, a brake for the carriage in one direction of its displacement, and a grasping device for the carriage. The brake for the carriage (14) comprises a set of elastic cords (11) of which one extremity of each is retained on a base (6) of the beam (1) and the other extremity, in active position, after passing about a pulley (13) is adapted to be connected by the user to an element of the carriage (14). In the active position, this latter extremity is adapted to be retained by another element (18) itself connected to a cover (16) of the beam (1). The brake for the carriage (14) may comprise in combination with the cords (11), a set of weights (67).

7 Claims, 11 Drawing Figures

MECHANICAL THERAPEUTIC APPARATUS

OBJECTS OF THE INVENTION

The present invention has as an object a mechanical therapeutic apparatus permitting the practice of a corrective exercise for the back and for the spinal column and to effect other gymnastic movements so as not only to work the biceps and the triceps, but also to develop the musculature of the legs.

One of the objects of the invention is to realize such an apparatus that is easily assembled and disassembled by the user. The said apparatus permits in addition, with the aid of different accessories, to be used for multiple exercises.

Another object of the invention is to reduce as much as possible the weight of the apparatus in view of facilitating its transport, and to reduce the dimensions and the cost of manufacture.

Other advantages and characteristics of the invention will appear from the description that follows.

BRIEF DESCRIPTION OF THE DRAWINGS

The accompanying drawings are given by way of example.

DETAILED DESCRIPTION OF THE INVENTION

Figure 1:
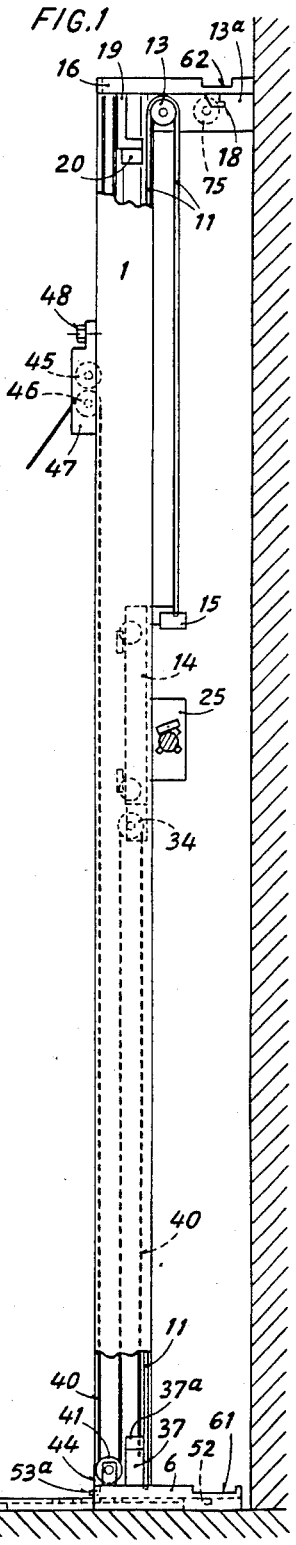
FIG. 1 shows a side view of a mechanical therapeutic device according to the invention.
Figure 9:
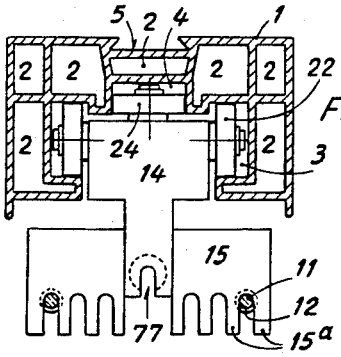
FIG. 9 is an end view of the upper portion of the element shown in FIG. 5 in transverse section of another portion of the apparatus represented in FIG. 1.

According to the invention, the apparatus shown in FIG. 1 comprises a vertical rectilinear beam 1 of aluminum alloy, the section of which is shown in FIG. 9. The said beam is provided with cavities 2 that contribute to its reduction in weight, a longitudinal housing 3 of generally rectangular shape, open at the rear, a second longitudinal housing 4 of U-shape, narrower than the first and opening into this latter. The front face of the beam 1 comprises over its entire length a channel 5 having rounded shanks, the purpose of which will be explained later (FIG. 9).

A base 6 (FIG. 3), supporting the beam 1, is provided with four holes 7 designed to assure its fixation to the floor with the aid of four screws not shown. It comprises in addition an extended and transverse opening 8 with, in its middle, a disengagement 9; L-shaped stops 10 form projections on the base 6 and are disposed so as to penetrate each in a corresponding cavity 2 of the beam 1, so as to position the said beam with respect to the said base.

Elastic cords 11 of round section (FIGS. 1, 2, 3) provided at each extremity with metallic cylindrical heads 12 of greater diameter (FIG. 3), are each retained at the head of their lower extremity in the opening 8, after the said heads have been introduced through the central disengagement 9 and slid sideways. In the present embodiment, six elastic cords 11 are shown in section in FIG. 3, one next to the other on both sides of the disengagement 9.

Figure 6:
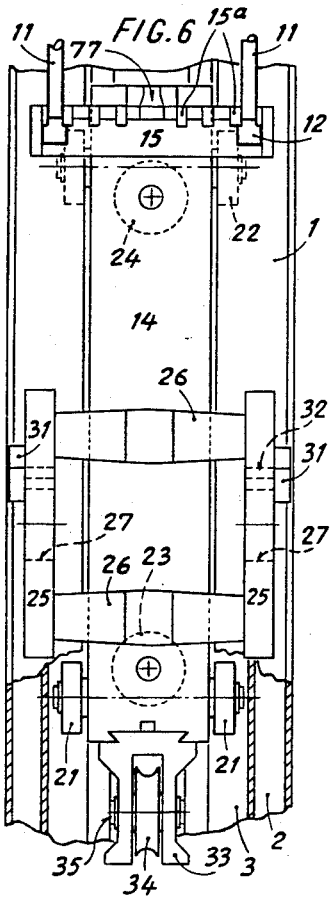
FIG. 6 is a view from the rear surface of the element shown in FIG. 6.

The elastic cords in period of use, stretched the length of the beam 1, each pass in the groove of a pulley 13 and are connected to a carriage 14 (FIGS. 1, 5, 6) by the head 12. The carriage 14 comprises to this effect a rake 15 (visible in FIGS. 5, 6, 7 and 9) provided with teeth 15*a* in the gaps of which are retained the elastic cords 11 by their respective heads 12. To be placed in the inactive mode, the cords 11 are easily removed from the rake 15 (FIGS. 5, 6 and 9) by the user, while the carriage 14 is in its upper position. The apparatus comprises six pulleys 13 mounted for rotation about an axle integral with two supports 13*a* formed from a single element with a cover 16.

Figure 2:
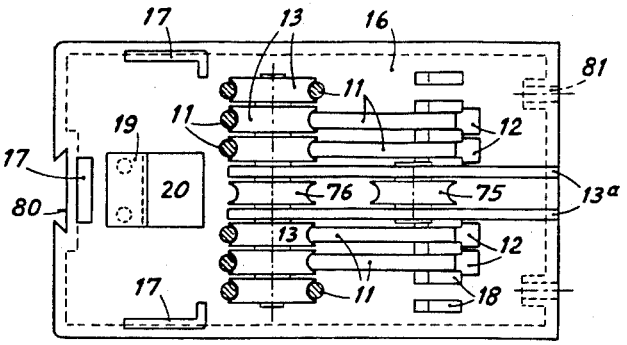
FIG. 2 is a front view and from above, on a larger scale of a portion of the said apparatus.

The cover 16, shown in FIG. 2, as seen from below comprises three projections 17 introduced in three of the corresponding cavities 2 (FIG. 9) at the top of the beam 1, so as to position the said cover with respect to the upper part of the said beam. An assembly of parallel teeth 18 formed from a single piece with the cover 16 are made to project below this latter and are adapted to retain in inactive position one or several of the elastic cords 11 the heads 12 of which are held between the teeth 18 under the effect of the residual tension of the cords 11. In FIG. 2 and by way of example, are shown two elastic cords 11 in inactive position, the four others, shown in section, being in active position. A support 19 fixed to the cover 16 (FIGS. 1 and 2) carries at its lower portion a damping stopper, for example, of rubber 20, which constitutes an abutment for the carriage 14 in its upper position.

The carriage 14 is provided with two pairs of lateral rollers 21, 22 carried by parallel axles fixed to the said carriage. The said rollers are engaged in the longitudinal housing 3 of the beam 1. Two other rollers 23, 24, with axles perpendicular to those of the rollers 21, 22, are engaged in the second longitudinal housing 4 of the said vbeam (FIG. 9). It must be noted that the rollers 21, 22, 23 and 24 are so dimensioned as to provide the play necessary for their rolling on the one or the other of the walls of the housings 3 and 4; furthermore they are covered at their periphery with a ring of rubber adapted to reduce the noise of rolling during displacement of the carriage 14 on the beam 1.

The carriage 14 additionally comprises two lateral supports 25, preferably of a resistant thermoplastic material, fixed respectively by four screws (not shown), in the vicinity of the extremities of two transverse cross-pieces 26 integrally formed from the carriage 14. The supports 25 comprise respectively two circular holes 27 of the same diameter and centered on the same axis intended to retain a bar 28 bent symmetrically in a same plane on both sides of the carriage 14 and constituting a grasping means for the user.

Figure 5:
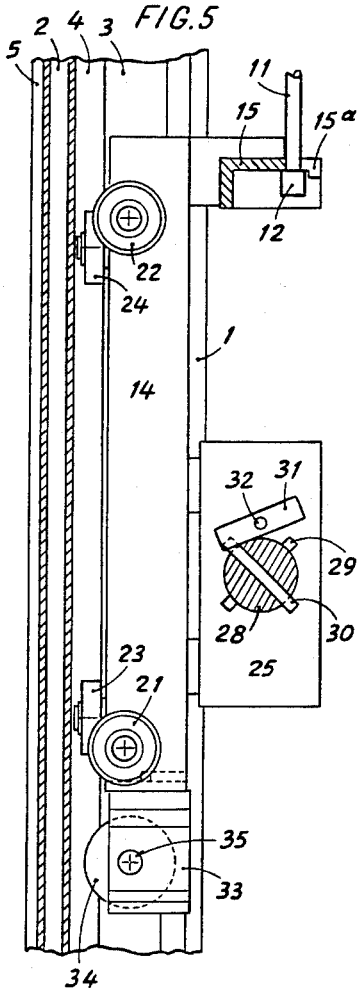
FIG. 5 is a side view in partial section and in increased scale of an element of FIG. 1.
Figure 7:
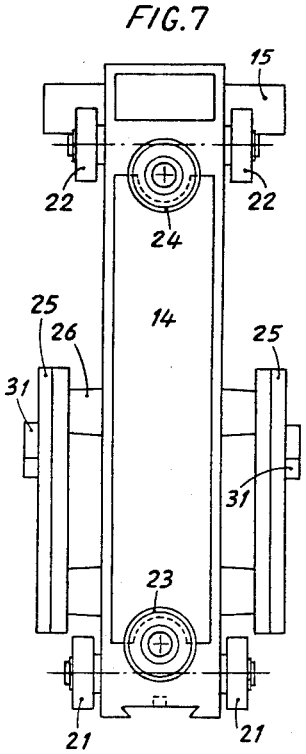
FIG. 7 is a view from the front surface of the element shown in FIG. 5.

The extremities of the bar 28 form with its central portion, engaged in the carriage 14, an angle which may be preferably comprised between 5°and 12°. The holes 27 are provided at their periphery with a set of one-eyed rectangular openings 29 disposed radially and diametrally opposed in two of which is adapted to engage the extremities of a transverse pin 30 fixed to the bar 28 when the said bar is threaded in the two holes 27 (FIG. 5).

Figure 4:
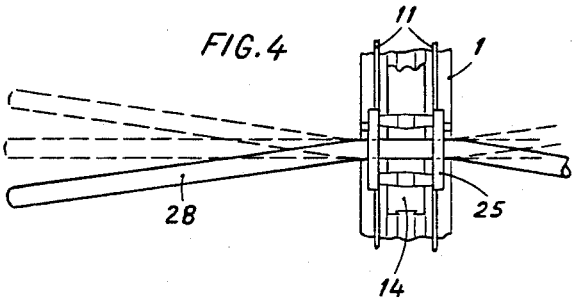
FIG. 4 is a frontal view from the rear and on an enlarged scale of a portion of FIG. 1.

In the example shown, the bent bar 28 (in section in FIG. 5) can occupy four positions as chosen by the user (FIG. 4). A movable bolt 31 mounted for rotation about an axle 32 (FIGS. 5 and 6) fixed to the support 25 is adapted to retain an extremity of the pin 30 in one of the corresponding openings 29 and chosen to that effect, so as to prevent any angular and transverse displacement of the bar 28 in its position of use.

A locking system 29, 30, 31, 32 such as described above may be provided on each of the supports 25 so as to make possible the introduction and the locking of the bar 28 in the holes 27 from the right as well as from the left of the carriage 14.

It will be notedd that the rear portion of the carriage 14 (the supports 25 and the rake 15) are made to project behind the beam 1; similarly, so is the central portion of the bar 28. There results from this disposition various advantages among which will be mentioned an easy accessibility for the user to the various or working parts of the carriage 14, as well as the possibility of an optimum route of the said carriage over nearly the totality of the height of the beam 1.

Figure 8:
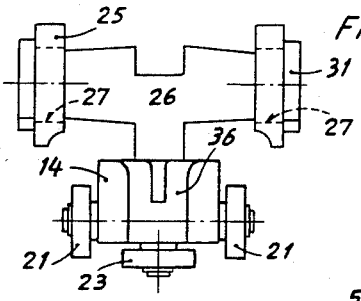
FIG. 8 is an end view of the lower portion of the element shown in FIG. 5.

At its base the carriage 14 comprises an accessory and removable pulley holder 33, provided with a pulley 34, the axle 35 of which is fixed to the said pulley holder, itself adapted to be introduced by the user in a rounded shank column 36 (FIG. 8) effected at the lower part of the carriage 14.

An inverted U-shaped metallic element 37, (FIG. 3) fixed to the base 6 by two screws 38, is provided at its middle with an opening 39 adapted to receive and retain the knotted extremity of a cord 40. This latter passes in the groove of the pulley 34, then descends once again to be applied next in the groove of a pulley 41, the axle 42 of which is fixed to the base 6 by two projecting elements 43 formed integrally from the said base. The element 37 carries an elastic stopper 37*a* (for example of rubber) adapted to receive the carriage 14 in its lower position.

A bored opening 44, at the base of the beam 1, permits the cordd 40 to rise again, exteriorly to the said beam, in the column 5 (FIG. 9) and to pass between the grooves of two adjacent pulleys 45 and 46, of which the parallel axles between them are fixed to a slider 47 housed in the column 5 and adapted to be displaced to a suitable height by the user, then stopped with the aid of a locking bolt 48 fixed to the said slider.

It must be noted that the exterior extremity of the cord 40 may be tightened and loosened in all the directions desired by the user and without significant friction, thanks to the presence of the said pulleys 45 and 46 of which the two grooves are adjacent the one to the other.

Figure 3:
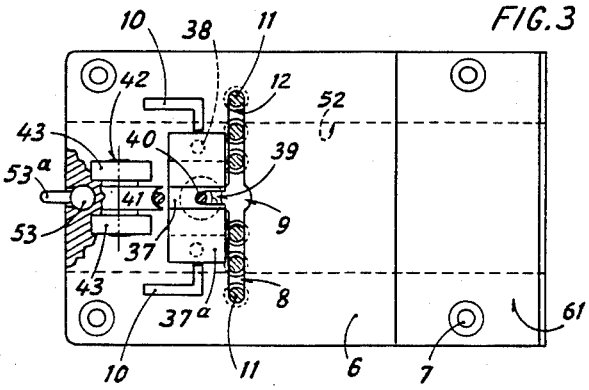
FIG. 3 similarly in enlarged scale is a front view and from below, in partial section, of a portion of FIG. 1.

A seat 49 (FIG. 1) is fixed, in a position suitably inclined toward the beam 1, on a seat post 50 fixed to a platform 51 in the shape of an inverted U. The said platform is adapted to be slid in a housing 52 provided for this purpose beneath the base 6 so as to enable advancing or retracting at will the seat 49 from the beam 1. The platform 51 additionally comprises a series of holes 52*a* in each of which may be engaged a vertical and movable pin 53 (FIG. 3) fixed to a transverse finger 53*a*. The pin 53 and the finger 53*a* are shown in FIG. 3 with an upper part of the base 6 in partial broken line, in a hole in which may be displaced the said pin when the user actuates the finger 53*a*. The preselected hole 52*a*, the pin 53 and its finger 53*a* constitute a locking device for the seat 49 at a suitable distance from the beam 1.

A steel plate 54 (FIG. 1) provided with a series of holes 55 is adapted to be slid between the side walls of the platform 51 and comprises in advance of the seat 49 a footrest constituted by a vertical upright 56 and at least one transverse bar 57 introduced into one of the holes 58 of the said upright. The distance comprised between the footrests 56, 57 and the seat 49 is adjustable by displacement of the plate 54 beneath the platform 51. A pin (not shown) controlled manually by a finger 59 is introduced into one of the holes 55 so as to lock, at a suitable distance, the footrests 56, 57. The manually controlled finger 59 may be displaced in an extended opening 60 formed in the seat post 50.

It results from these arrangements that the seat 49 and the footrests 56, 57 may, separately or in combination, be displaced by the user all while remaining attached to the beam 1 after setting of each one of them, by the two locking devices described above. If needed, the seat 49 and the footrest 56, 57 may be entirely removed by displacement of each one of them toward the left after unlocking.

Figure 11:
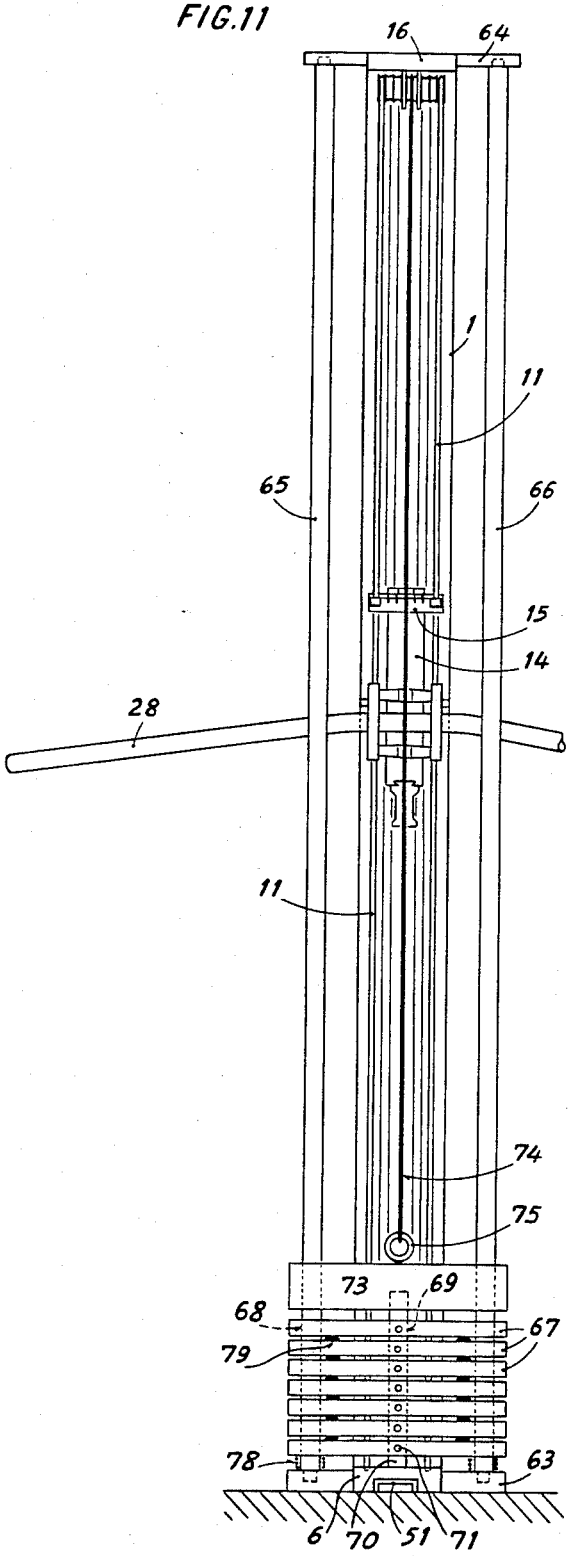
FIGS. 10 and 11 are side views from the rear of the apparatus according to FIG. 1, provided with a set of accessories.
Figure 10:
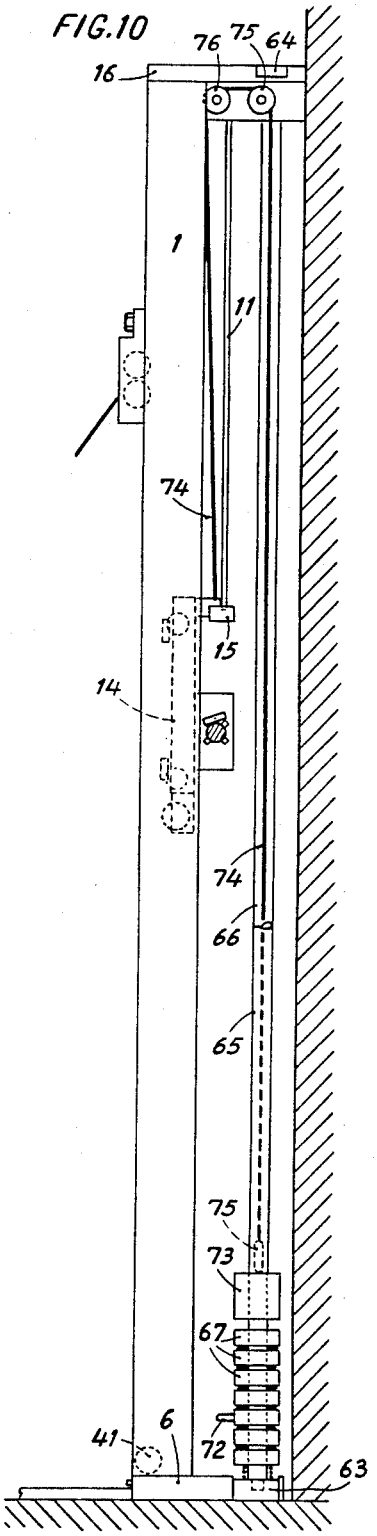

FIGS. 10 and 11 illustrate the apparatus shown in the preceding figures, provided with a set of accessories that are easily adjusted by the user to the rear of the beam 1.

To this effect, the base 6 and the cover 16 comprise two channels 61 and 62 (FIG. 1) which may receive respectively rectangular supports 63 and 64, the extremities of which, extending beyond both sides of the beam 1 (FIG. 11), are connected to each other by vertical, parallel bars 65 and 66. Superposed steel plates or weights 67 are provided with side holes 68 through which pass the bars 65 and 66 with the clearance necessary to permit a movement of vertical translation of the said plates. These latter additionally each comprise a central opening 69 in which may slide a vertical spindle 70, itself provided with holes regularly spaced with respect to corresponding transverse orifices 71 affected in the weights 67.

The spindle 70 may be fixed to all or part of the weights 67 through the introduction of a pin 72 in one of the holes 71. Said spindle is fixed at its upper extremity to a spindle holder 73 adapted, in the manner of the weights 67, to slide the length of bars 65, 66. The extremity of a cord 74 is attached to a ring 75 fixed to the spindle holder 73.

The cord 74 passes, parallel to the bars 65, 66, in the grooves of two pulleys 75 and 76 (FIGS. 2 and 10), the parallel axles of which are fixed to supports 13*a*. It then redescends toward the carriage 14 to which it is fixed with the aid of a knob effected at its extremity, the said knob penetrating in a central groove 77 (FIGS. 6 and 9) of the rake 15.

The lower weights 67 (FIGS. 10 and 11) rest on two stoppers constituted by helical springs 78 through which pass the bars 65 and 66 while the elastic spacing elements 79 are fixed above or below the weights 67.

Finally, it must be noted that the cover 16 comprises a rounded-shank channel 80 (FIG. 2) that coincides with the extremity of the channel 5 (FIG. 9), when the said cover covers the top of the beam 1. Two holes 81 provided in an edge of the cover 16 permit fixing this latter with the aid of screws (not shown) against a wall.

The functioning of the apparatus is as follows: the user adjusts the position of the seat 49 and that of the footrest 56, 57, to a suitable distance from the beam 1 and introduces, if it is not already there, the bent bar 28 in the openings 27 of the supports 25 fixed to the carriage 14 (FIGS. 1 and 4). The angular orientation of the extremities of the bar 28 is adjusted through fastening of the pin 30 (FIG. 5) in the required openings 29 with the aid of the bolt 31.

Judicious orientation of the extremities of the bar 28 is indispensable so as to realize through a suitable exercise a progressive, corrective effect for the back of a patient and an increase in its musculature.

Before commencing exercise, the carriage 14 is in its upper position, resting against the stopper 20. The preselected elastic cords 11 have been set in active position (FIG. 6), while the other cords are retained in inactive position as shown in FIG. 2. The user then takes hold with both hands of the bar 28 in the vicinity of its extremities and pulls downward the carriage 14 against the elastic force resulting from the stretching of cords 11, positions himself on the seat 49, his feet resting on each side of the bar 57 serving as footrests.

The user, once positioned, effects vertical back and forth movements which have the effect of successively stretching and unstretching the elastic cords 11 in active position. By virtue of the footrests 56, 57 and the suitable inclination of the seat 49, the base of the back of the user remains constantly applied against the beam 1, an important condition for the satisfactory conduct of the muscular exercise.

It must be additionally noted that the course of the carriage 14 is limited over the height of the beam 1 only by the stoppers 20 and 37a which define the maximum amplitude of displacement of the said carriage.

With the aid of the described accessories shown in FIGS. 10 and 11, the user may augment the traction effort on the bar 28 by attaching to the elastic force of the cords 11, one or several weights 67 carried by the spindle 70 and the spindle holder 73 after introduction of the pin 72 in one of the holes 71. In putting the series of cords 11 in active position, the user may resort uniquely to the constant force of the weights 67.

It therefore results from the invention that the apparatus described permits combining the activity, separately or in combination, of two sets of forces, one elastic, the other constant.

The user being standing, facing the apparatus, may additionally perform other muscular exercises by pulling on the free end of the cord 40 (FIG. 1) passing between the grooves of pulleys 45 and 47 of the slider 47. To this effect, the user may easily extract the bar 28 from the carriage 14 and attach it to the end of the said cords so as to serve as a grasping means.

The slider 47 is brought to a suitable height in the channel 5 and fastened by locking of the bolt 48 with the aid of a removable key (not shown). In its upper position the slide 47 permits a pulling of the cord 40 downward, while at the lower position of the slider 47 the traction is exerted toward the top. Other exercises resort to the possibility of lateral pulling on the said cord, this latter being able in effect to be urged in all the directions in front of the beam 1 without harmful friction.

When the cord 40 is not used, the pulley holder 33 is extracted from the channel 36 (FIGS. 8 and 9) to be laid asicde in the vicinity of the apparatus such that the cord 40 will be disconnected from the carriage 14 to permit the practice of other exercises described previously.

It goes without saying that the mechanical therapeutic apparatus according to the invention has been described only by way of an example, and that diverse modifications thereof may be carried out without departing from the scope of the invention.

I claim:

1. Mechanical therapeutic apparatus comprising: a vertical beam having a front surface; a seat connected to said vertical beam at a distance from said front surface such that a user can rest his back on said front surface when seated on said seat, means to adjust the distance of said seat from said front surface of said beam; and said seat having means for adjusting it's height; a foot rest connected to said vertical beam said footrest being spaced from said seat a distance such that a user can rest his feet on said footrest when seated on said seat; a carriage movable vertically along said beam, means located within said beam for guiding the movement of said carriage, said carriage having an opening, grasping means comprising a transverse bar adapted to be introduced in the opening of the carriage; means for braking the carriage against its downward movement; said braking means comprising a set of elastic cords of which one extremity of each is retained on a base of the beam and the other extremity, after passing over a pulley, is removably connected to an element of the carriage in active position and to an element fixed to the beam in inactive position; said braking means further comprising a set of weights mounted for vertical movement along vertical guides; and means for coupling at least one of said weights to the carriage including a rod vertically displaceable within the set of weights, locking means for connecting a selected one of said weights to said rod, and a flexible pulling member connected at one end to said rod and at the other end to the upper end of said carriage, said flexible pulling member passing over pulleys journaled at the top of the apparatus.

2. Mechanical therapeutic apparatus according to claim 1, in which the carriage includes a rake having a plurality of teeth, and the cords include a head at each of their extremities, the lower head being retained by the base and the upper head, in an active position of the cord, being fixed to the carriage by insertion into the gap between two successive teeth of the rake.

3. Mechanical therapeutic apparatus according to claim 1, said bar being symmetrically bent on both sides of the said carriage.

4. Mechanical therapeutic apparatus according to claim 3, in which the carriage additionally comprises at least one locking device adapted to fix the bar angularly and transversely with respect to the carriage.

5. Mechanical therapeutic apparatus according to claim 4, in which the locking device includes a set of openings disposed about the periphery of the carriage opening, a pin connected to the bar and adapted to be engaged in a selected opening, and a bolt mounted on the carriage and movable about an axle for retaining said pin in said opening.

6. Mechanical therapeutic apparatus according to claim 5, in which the carriage comprises a locking device placed on each side of the said carriage so as to make possible the locking of the bar from the right as well as from the left of the carriage.

7. Mechanical therapeutic apparatus according to claim 1, in which the carriage comprises at its base a removable pulley holder, a pulley carried by said pulley holder (33), and a cord secured fixedly at one end to the apparatus and passing over the last-named pulley and having a free end adapted to be pulled by the user to pull down the carriage against the action of said braking means.

* * * * *